US008418932B2

(12) United States Patent
Seki et al.

(10) Patent No.: US 8,418,932 B2
(45) Date of Patent: Apr. 16, 2013

(54) WHEEL GUARD APPARATUS

(75) Inventors: Masaki Seki, Nagoya (JP); Kazuhiro Miwa, Nagoya (JP); Tomomi Funada, Nagoya (JP); Hironari Muramatsu, Nagoya (JP); Takaaki Irie, Himeji (JP); Yoshio Morikawa, Himeji (JP); Katsunari Konishi, Himeji (JP); Tetsuya Hanazaki, Himeji (JP)

(73) Assignees: Central Japan Railway Company, Nagoya-shi (JP); Yamato Trackwork System Co., Ltd., Himeji-shi (JP)

( * ) Notice: Subject to any disclaimer, the term of this patent is extended or adjusted under 35 U.S.C. 154(b) by 158 days.

(21) Appl. No.: 12/745,243

(22) PCT Filed: Nov. 28, 2008

(86) PCT No.: PCT/JP2008/003518
§ 371 (c)(1),
(2), (4) Date: Oct. 25, 2010

(87) PCT Pub. No.: WO2009/072258
PCT Pub. Date: Jun. 11, 2009

(65) Prior Publication Data

US 2011/0049254 A1 Mar. 3, 2011

(30) Foreign Application Priority Data

Dec. 6, 2007 (JP) ..... 2007-315424

(51) Int. Cl.
*E01B 5/18* (2006.01)

(52) U.S. Cl.
USPC ..... 238/17

(58) Field of Classification Search ..... 238/17, 238/18, 20, 23
See application file for complete search history.

(56) References Cited

U.S. PATENT DOCUMENTS 5,115,970 A * 5/1992 Rice et al. ..... 238/17
7,891,577 B2 * 2/2011 Seki et al. ..... 238/18
(Continued)

FOREIGN PATENT DOCUMENTS

EP 0 402 351 A2 12/1990
EP 1 895 053 A1 3/2008
(Continued)

OTHER PUBLICATIONS

Extended European Search Report for EP 08856614.6-2303, dated Mar. 7, 2012.

(Continued)

*Primary Examiner* — S. Joseph Morano
*Assistant Examiner* — Zachary Kuhfuss
(74) *Attorney, Agent, or Firm* — Marshall, Gerstein & Borun LLP

(57) ABSTRACT

A wheel guard apparatus capable of preventing a wheel from derailing and preventing a vehicle from seriously deviating from a track even if the wheel has derailed includes a fixed portion fixed to a railroad tie located between main line rails; a movable portion supported by a rotating shaft provided on the fixed portion and extending in a horizontal direction and configured to be rotatable around the rotating shaft toward a track center side; and a guard rail located at a position separated from the rotating shaft of the movable portion and held to extend in parallel with the main line rail. The guard rail includes an outer stopper portion configured to prevent the wheel from derailing toward an inner side of the main line rail and an inner stopper portion configured to prevent a derailed vehicle from deviating to an outer side of a track.

6 Claims, 13 Drawing Sheets

U.S. PATENT DOCUMENTS

| | | | | |
|---|---|---|---|---|
| 2009/0200389 | A1* | 8/2009 | Seki et al. | 238/18 |
| 2011/0049254 | A1* | 3/2011 | Seki et al. | 238/17 |
| 2011/0121088 | A1* | 5/2011 | Seki et al. | 238/17 |
| 2011/0121089 | A1* | 5/2011 | Seki et al. | 238/17 |

FOREIGN PATENT DOCUMENTS

| | | | |
|---|---|---|---|
| JP | 56-176202 | U | 12/1981 |
| JP | 2006-063790 | A | 3/2006 |
| JP | 2006-112215 | A | 4/2006 |
| JP | 2006-328644 | A | 12/2006 |
| WO | WO-2007/105672 | A1 | 9/2007 |

OTHER PUBLICATIONS

International Search Report for PCT/JP2008/003518, mailed Mar. 3, 2009.

* cited by examiner (a)

(b)

WHEEL GUARD APPARATUS

TECHNICAL FIELD

The present invention relates to a wheel guard apparatus disposed along a main line rail of a railroad.

BACKGROUND ART

As shown in FIG. 14(*a*), conventionally, in a case where ballast 103 is spread and railroad ties 104 are laid on a track, in order to prevent the track from sinking, ballast 102 immediately under a main line rail 101 to which a load is most strongly applied is dense whereas ballast 103 other than the ballast 102 is comparatively sparse. However, as shown in FIG. 14(*b*), the ballast 103 immediately under the rail gradually becomes sparse with time by a high vertical load applied thereto via the main line rail 101. Therefore, the ballast 103 immediately under the main line rail 101 is tamped by a tie tamper, a multiple tie tamper, or the like (hereinafter collectively called a "tamping machine"), not shown, at predetermined time intervals or the like in order to prevent a filling density of the ballast from becoming low.

As shown in FIGS. 15(*a*) and 15(*b*), a safety rail 105 may be laid along the main line rail 101 for the purpose of preventing a derailed vehicle from seriously deviating to an outer side of the track and minimizing damages of the derailment even in a case where a train runs on, for example, a curved track and its wheel has derailed from the main line rail 101. The safety rail 105 may be laid on a track inner side of the main line rail 101. Moreover, at a place where rocks or snow frequently fall or at a place where the safety rail 105 is especially required, the safety rail 105 may be laid on an outer side of the main line rail 101.

As shown in FIG. 16, in the case of the curved track, a guard member 106 for preventing the wheel from derailing from the main line rail 101 is generally laid on a track so as to be in parallel with the main line rail 101.

FIG. 16 is a plan view showing a working range of the tamping machine, and regions shown by diagonal lines are the working ranges of the tamping machine. As shown in FIG. 16, the tamping work of the ballast 102 by the tamping machine needs to be carried out such that the ballast immediately under the main line rail 101 is tamped in the vicinity of the main line rail 101. However, since the guard member 106 and the safety rail 105 are laid in the working range, these structures need to be temporarily removed before the work of the tamping machine to a place other than the regions shown by the diagonal lines. Then, the structures temporarily removed need to be restored after the work is done.

However, the conventional guard member 106 is laid using a fastening structure including a large number of combinations of bolts and nuts, it is extremely troublesome to attach and detach the guard member 106. In addition, it takes much time and labor to move by hand the guard member 106 that is a heavy product to a place away from the main line rail 101.

The same is true for the safety rail 105. That is, since the safety rail 105 that is a heavy product becomes an obstacle during the work of the tamping machine, the safety rail 105 needs to be moved by hand to a place away from the main line rail 101, which requires much time and labor.

A maintenance work of the main line rail 101 is carried out at predetermined time intervals (for example, once or twice a year) for comfortable ride of trains. In the maintenance work, the main line rails 101 are objectively evaluated by data, such as vibration greatness, a swing direction, and the like of a running vehicle, and if the main line rail 101 exceeds a reference value, a rail grinding work of grinding the main line rail 101 to a predetermined shape by a rail grinding vehicle running on the main line rail 101 is carried out. By the rail grinding work, each of numerical values regarding the vibration greatness, the swing direction, and the like of the running vehicle falls within an appropriate range. The rail grinding work is carried out with respect to not only the track including the ballast but also the main line rail 101 on a slab track according to need.

Since the guard member 106 and the safety rail 105 laid along the main line rail 101 become obstacles during the rail grinding work, the guard member 106 and the safety rail 105 that are heavy products need to be moved by hand to a place away from the main line rail 101, which takes much time and labor.

Moreover, in the case of replacing the main line rail 101, the guard member 106 and the safety rail 105 need to be moved by hand to such a place that the guard member 106 and the safety rail 105 do not become obstacles.

Therefore, the present applicant has filed an application describing that the guard rail is laid along the main line rail using this type of wheel guard apparatus to prevent the wheel from derailing, and the position of the guard rail can be quickly changed to an evacuation position away from the main line rail (see Patent Document 1).

Moreover, the present applicant has also filed an application describing that even if the vehicle has derailed, the derailed vehicle is prevented from seriously deviating from the track, so that the derailed vehicle is prevented from contacting an oncoming vehicle. In accordance with the above application, even if the wheel has derailed, an inner side of the wheel is stopped in the vicinity of a width-direction center of the railroad tie, so that the vehicle is prevented from seriously deviating from the track (see Patent Document 2).

Patent Document 1: Japanese Laid-Open Patent Application Publication No. 2006-328644

Patent Document 2: Japanese Laid-Open Patent Application Publication No. 2006-112215

DISCLOSURE OF THE INVENTION

Problems to be Solved by the Invention

In accordance with Patent Document 1, the wheel can be prevented from detailing in an initial stage of a process in which the wheel derails from the main line rail. However, if the wheel has derailed from the main line rail, the vehicle may seriously deviate from the track. In accordance with Patent Document 2, even in a case where the wheel has derailed, the vehicle can be prevented from seriously deviating. However, the wheel cannot be prevented from derailing from the main line rail.

Preventing the wheel from derailing or preventing the vehicle whose wheel has derailed from deviating from the track may be applied depending on conditions of the main line rail and the like. However, in order to obtain both functions of preventing the wheel from derailing and preventing the vehicle whose wheel has derailed from deviating from the track, it is necessary to carry out both Patent Documents 1 and 2. In this case, a large number of components need to be laid on the track, and it requires high cost and much labor.

Here, an object of the present invention is to provide a wheel guard apparatus which is capable of changing the position of the guard rail between a wheel derail prevention position along the main line rail and an evacuation position away from the main line rail and which can prevent the wheel from derailing and prevent the vehicle whose wheel has derailed from seriously deviating from the track.

Means to Solve the Problems

To achieve the above object, the present invention includes: a fixed portion fixed to a railroad tie or a slab track located between main line rails; a movable portion supported by a rotating shaft provided on the fixed portion and extending in a horizontal direction and configured to be rotatable around the rotating shaft toward a track center side; and a guard rail located at a position separated from the rotating shaft of the movable portion and held to extend in parallel with the main line rail, wherein the guard rail includes an outer stopper portion configured to prevent the wheel from derailing toward an inner side of the main line rail and an inner stopper portion configured to prevent a derailed vehicle from deviating to an outer side of a track. In the present description and claims, the "track" denotes a way on which the main line rails are laid in parallel with each other, undo "track center side" is an inner side between the main line rails. With this, by causing the movable portion to rotate around the rotating shaft toward the track center side, the guard rail at a derailment prevention position can be easily evacuated to an evacuation position. In addition, the wheel can be guarded by the outer stopper portion of the guard rail to be prevented from derailing, and the derailed vehicle can be stopped by the inner stopper portion of the guard rail to be prevented from seriously deviating to the outer side of the track.

Moreover, a holding surface of the movable portion which surface holds the guard rail may include a concave-convex thread configured to prevent the guard rail from shifting in a vertical direction. With this, even if the guard rail receives a high load, the guard rail is stably supported by the concave-convex thread.

Further, a load supporting portion configured to support a load applied from the movable portion to the fixed portion may be provided between the fixed portion and the movable portion. Used as the load supporting portion is, for example, a nested concave-convex portion having a large area by which the applied load is supported and transferred. With this, the load received by the guard rail and supported by the fixed portion via the movable portion is received by the load supporting portion. Thus, the load can be supported more stably.

Moreover, the present invention may further include a holding portion configured to hold the guard rail between the holding portion and the movable portion, wherein the holding portion may include an upper end supporting surface contacting the guard rail and having a circular-arc shape around an attaching portion by which the holding portion is attached to the movable portion and an engaging portion by which the holding portion engages with the movable portion. With this, even if the guard rail is held by the movable portion using the holding portion, and the holding portion is rotated due to the gap (backlash) of respective components with the circular-arc upper end supporting surface of the holding portion contacting the guard rail, the holding portion does not push up the guard rail.

In addition, the fixed portion may include a fixed seat having a fixed hole by which the fixed portion is fixed to the railroad tie or the slab track using a fixing member, and the fixed seat may include an inclined surface formed such that a load applied side of the fixed seat to which side the load is applied from the movable portion to the fixed portion is thicker than a load non-applied side of the fixed seat. A fixing bolt is preferable as the fixing member from a viewpoint of the versatility. With this, even if the coupling between the fixed seat and the railroad tie or between the fixed seat and the slab track by the fixing member is loose, the fixed seat obtains the wedging action for breaking into between the fixing member and the railroad tie or between the fixing member and the slab track by the load applied to the fixed seat in the horizontal direction and the inclined surface of the fixed seat contacting the railroad tie or the slab track. Thus, the fixed seat can be surely held by the railroad tie or the slab track.

Moreover, a partially cut portion having a predetermined length extending from an upstream end portion of the guard rail to a downstream outer stopper portion may be formed at an outer side portion of an upstream portion of the guard rail in a vehicle proceeding direction. With this, when the wheel moves from one guard rail to the next one with the wheel contacting the guard rail, and even if the guard rail deforms by the lateral force applied to the wheel, the wheel can smoothly transfer from one guard rail to the cut portion of the next guard rail.

Effect of the Invention

The present invention can provide the wheel guard apparatus capable of causing the guard rail to be evacuated to the track center side by the above-explained means and having both functions of preventing the wheel from derailing and preventing the vehicle from seriously deviating from the track even if the wheel has derailed.

BRIEF DESCRIPTION OF THE DRAWINGS

FIG. 3(*b*) is a perspective view of a transfer portion of the guard rail.

FIG. 4(*b*) is a front view of the fixed portion.

FIG. 6(*b*) is a side view showing a part of the movable portion.

FIG. 8(*b*) is a front view showing a force relation in a case where a force is applied from an inner side to the guard rail of the wheel guard apparatus.

EXPLANATION OF REFERENCE NUMBERS

Figure 1:
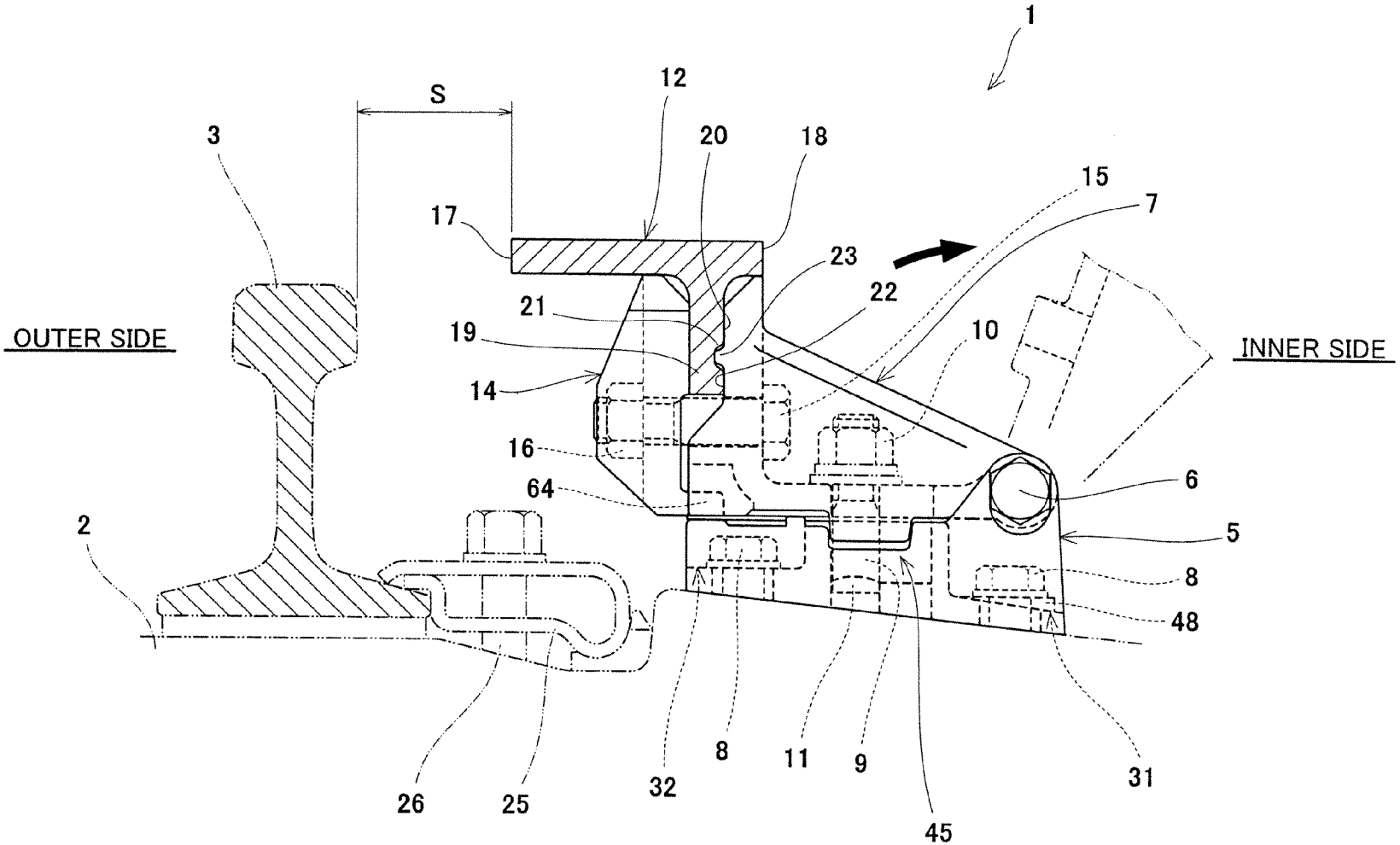
FIG. 1 is a front view showing a wheel guard apparatus according to one embodiment of the present invention.

1 wheel guard apparatus
2 railroad tie
3 main line rail
5 fixed portion
6 rotating shaft
7 movable portion
8 fixing bolt
9 connecting bolt
12 guard rail
14 holding portion
17 outer stopper portion
18 inner stopper portion
19 vertical portion
20 holding surface
21 concave thread
22 holding surface
23 convex thread
30 cut portion
31 inner fixed seat
32 outer fixed seat
33 inner fixing elongated hole
34 outer fixing elongated hole
35 attaching portion
41 inclined surface
45 load supporting portion
46 concave portion
47 inclined surface
48 inclined washer
49 fixed surface
52 holding wall
56 stopper wall
57 convex portion
63 upper end supporting surface
64 whirl-stop portion
C vehicle
D deviation prevention protruding portion
F load
W wheel

BEST MODE FOR CARRYING OUT THE INVENTION

Figure 2:
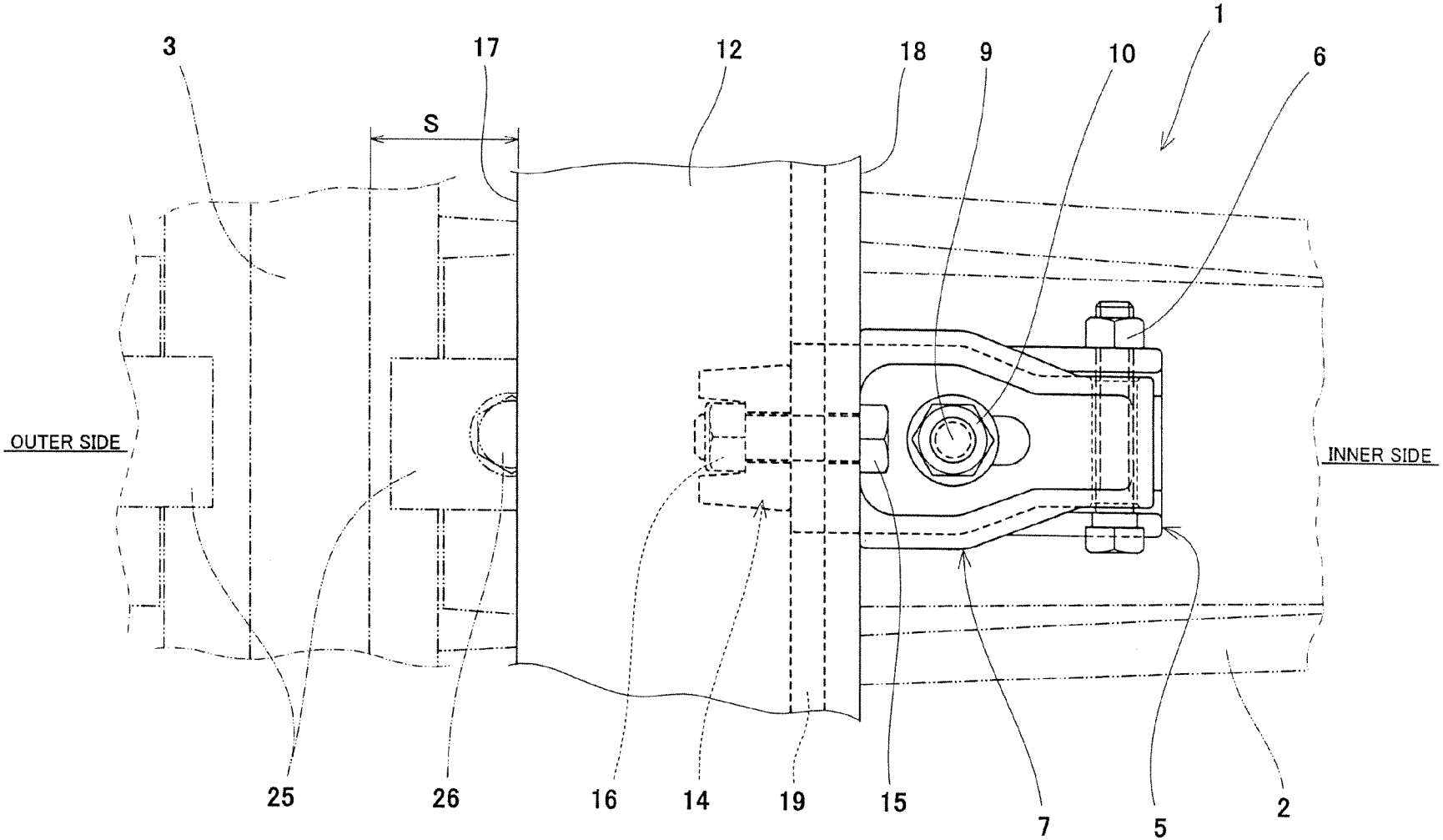
FIG. 2 is a plan view of the wheel guard apparatus shown in FIG. 1.
Figure 3:
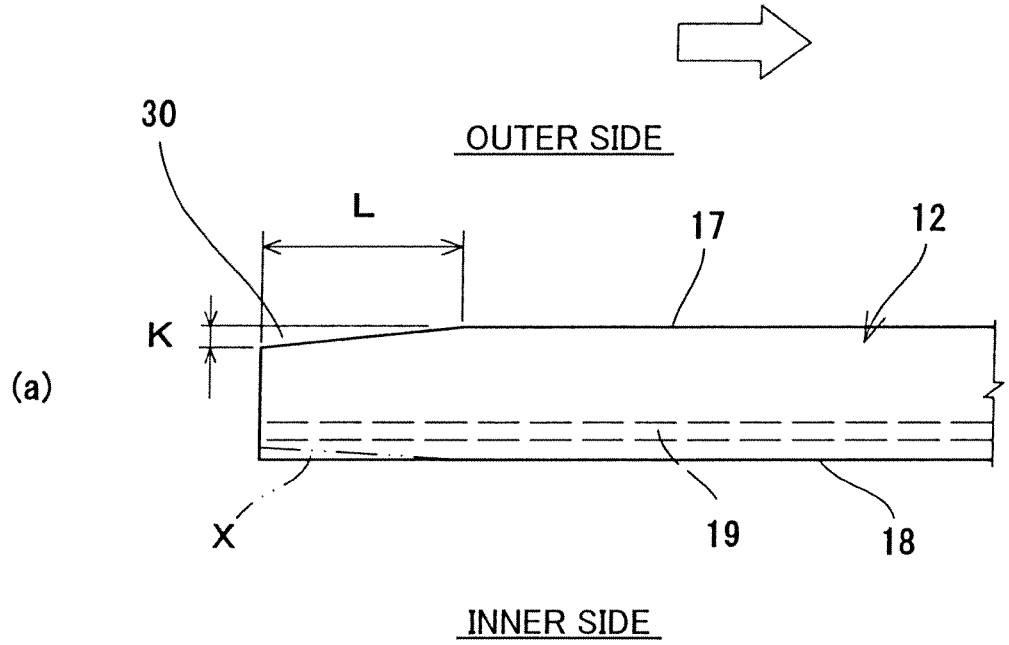
FIG. 3(*a*) is a plan view of an end portion of a guard rail of the wheel guard apparatus shown in FIG. 1.
Figure 3:
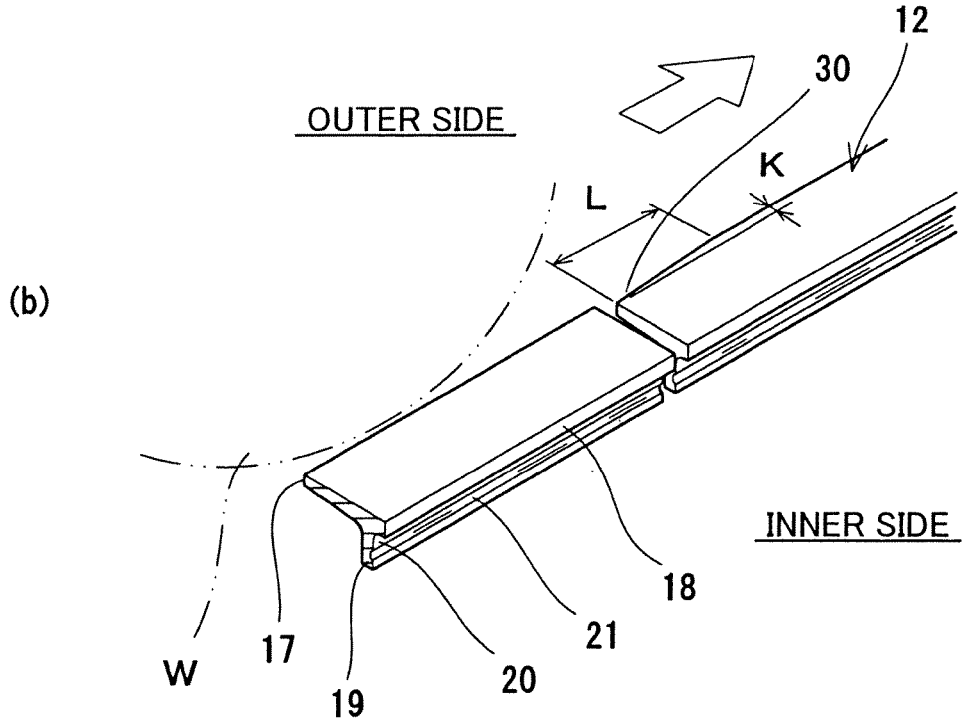
Figure 4:
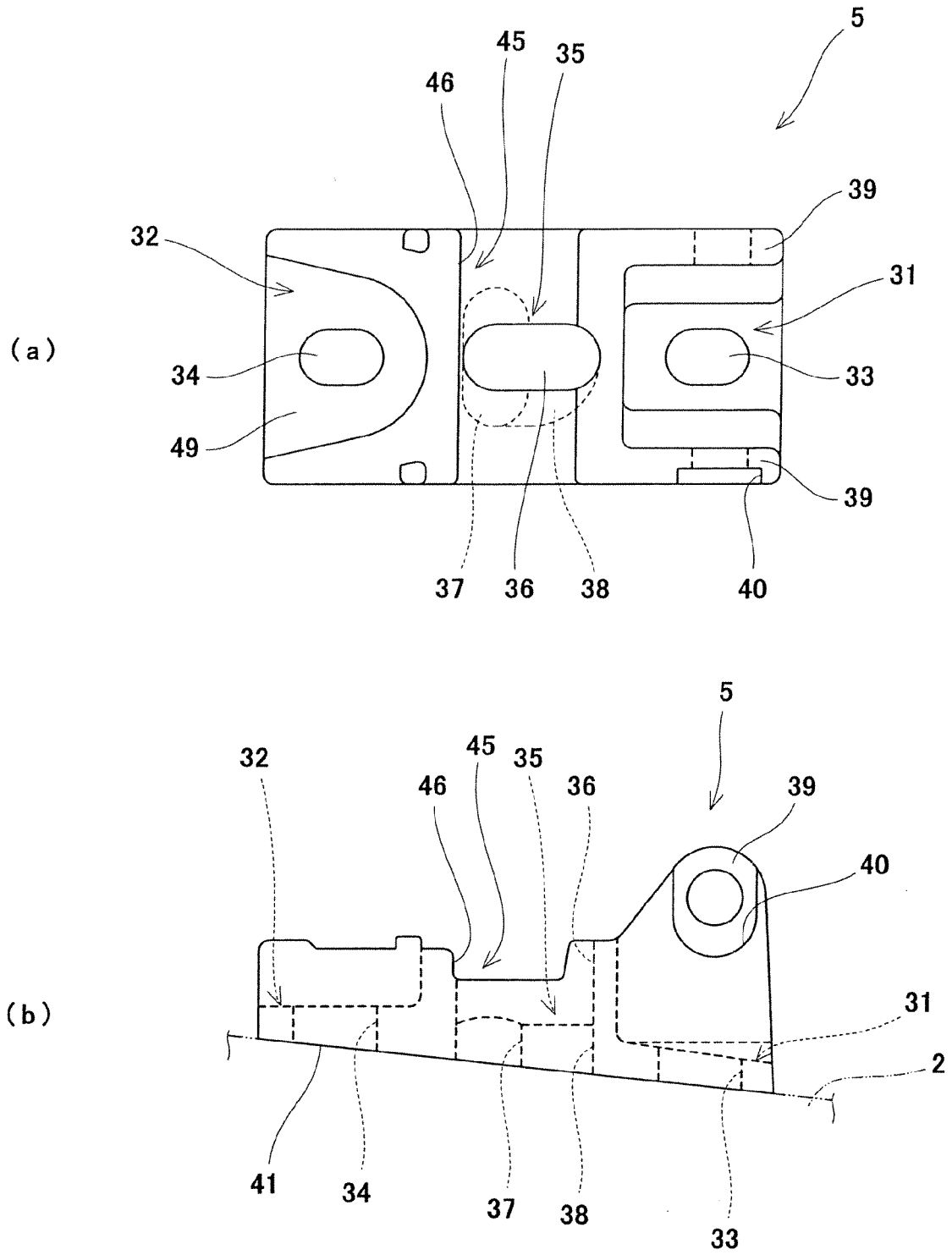
FIG. 4(*a*) is a plan view showing a fixed portion of the wheel guard apparatus shown in FIG. 1.
Figure 5:
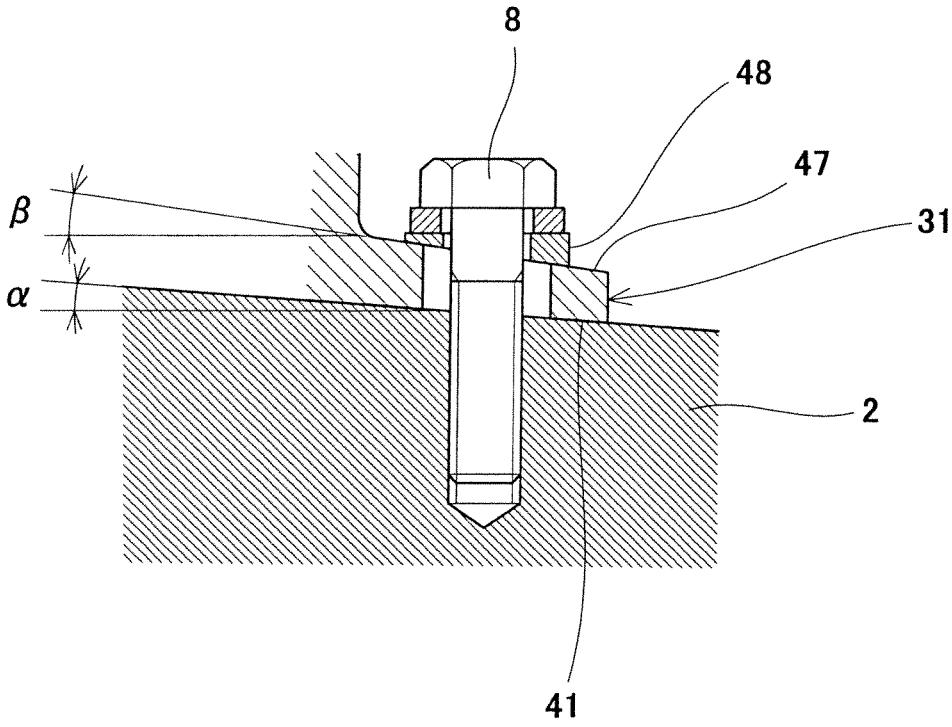
FIG. 5 is a front view showing a relation between and inner fixed seat of the wheel guard apparatus shown in FIG. 1 and a railroad tie.
Figure 6:
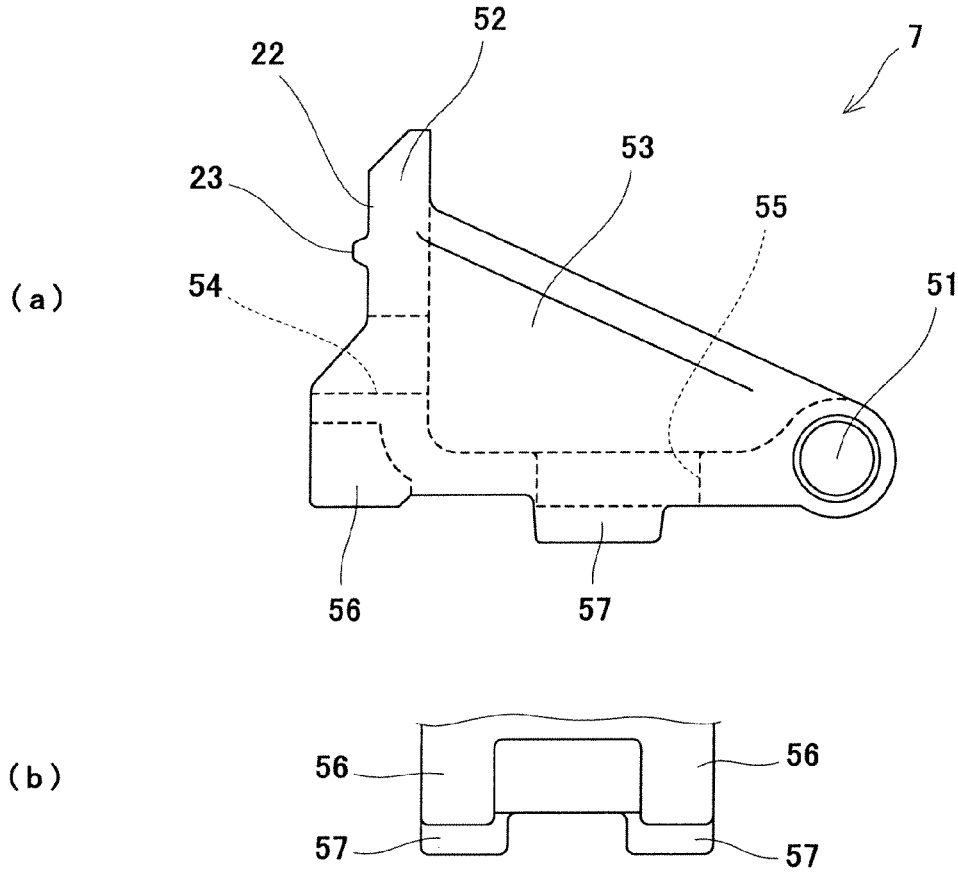
FIG. 6(*a*) is a front view showing a movable portion of the wheel guard apparatus shown in FIG. 1.
Figure 7:
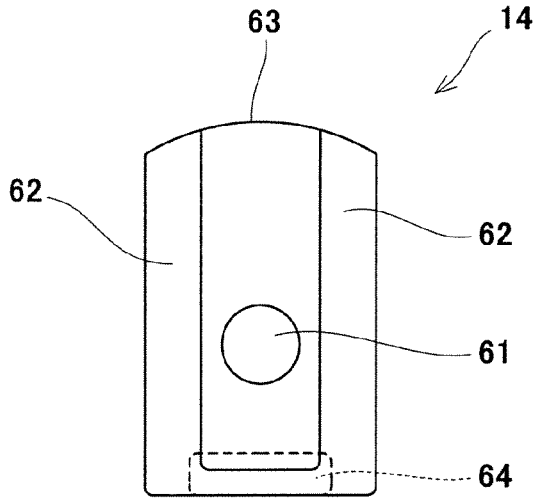
FIG. 7 is a side view showing a holding portion of the wheel guard apparatus shown in FIG. 1.

Hereinafter, one embodiment of the present invention will be explained based on the drawings. FIG. 1 is a front view showing a wheel guard apparatus according to one embodiment of the present invention. FIG. 2 is a plan view of the wheel guard apparatus shown in FIG. 1. FIG. 3(*a*) is a plan view of an end portion of a guard rail of the wheel guard apparatus shown in FIG. 1. FIG. 3(*b*) is a perspective view of a transfer portion of the guard rail. FIG. 4(*a*) is a plan view showing a fixed portion of the wheel guard apparatus shown in FIG. 1. FIG. 4(*b*) is a front view of the fixed portion. FIG. 5 is a front view showing a relation between and inner fixed seat of the wheel guard apparatus shown in FIG. 1 and a railroad tie. FIG. 6(*a*) is a front view showing a movable portion of the wheel guard apparatus shown in FIG. 1. FIG. 6(*b*) is a side view showing a part of the movable portion. FIG. 7 is a side view showing a holding portion of the wheel guard apparatus shown in FIG. 1.

A wheel guard apparatus 1 disposed on a railroad tie 2 will be explained as an example based on these drawings. In the present description and claims, an assembled state of the wheel guard apparatus 1 shown in FIG. 1 is defined as a front view, and the other drawings of respective components are shown based on a concept of directions determined in a case where the state in FIG. 1 is the front view. Further, an inner side denotes a portion between two main line rails 3 laid in parallel with each other, and an outer side denotes a portion outside each of the main line rails 3.

As shown in FIG. 1, the wheel guard apparatus 1 is disposed on the inner side of the main line rail 3 and is fixed to an upper surface of the railroad tie 2. The wheel guard apparatus 1 includes a fixed portion 5 fixed to the railroad tie 2 and a movable portion 7 which is supported by a rotating shaft 6 provided at the fixed portion 5 to extend in a horizontal direction and is capable of rotating around the rotating shaft 6 toward a track center side. An inner side portion and an outer side portion of the fixed portion 5 are fixed to the upper surface of the railroad tie 2 by fixing bolts 8. The movable portion 7 provided at the fixed portion 5 so as to be rotatable by the rotating shaft 6 is coupled to the fixed portion 5 by a connecting bolt 9 and a nut 10. The rotating shaft 6 may be a means other than the bolt.

Then, a guard rail 12 is held in parallel with the main line rail 3 at the main line rail side of the movable portion 7 which side is away from the rotating shaft 6. The guard rail 12 is sandwiched between the movable portion 7 and a holding portion 14. By fixing the holding portion 14 to the movable portion 7 by a guard rail fixing bolt 15 and a nut 16, the guard rail 12 is formed integrally with the movable portion 7 and the holding portion 14. The guard rail 12 is laid substantially in parallel with the main line rail 3 with a predetermined interval S therebetween. The movable portion 7 holding the guard rail 12 is rotatable around the rotating shaft 6 toward the track center side. The predetermined interval S between an outer stopper portion 17 of the guard rail 12 and an inner side of the main line rail 3 is set such that a wheel W does not derail (see FIG. 12) in a state where the wheel W is guarded by the outer stopper portion 17 of the guard rail 12. The position of the guard rail 12 shown in FIG. 1 in which the movable portion 7 is fixed to the fixed portion 5 is a derailment prevention position.

The guard rail 12 has a substantially T-shaped cross section. The outer stopper portion 17 is formed at outer end of a horizontal portion of the guard rail 12, and an inner stopper portion 18 is formed at an inner end of the horizontal portion of the guard rail 12. The vertical portion 19 holds the guard rail 12. A concave thread 21 extending in a longitudinal direction of the guard rail 12 is formed on an inner holding surface 20 of the vertical portion 19. Moreover, a convex thread 23 engaging with the concave thread 21 of the guard rail 12 is formed on a holding surface 22 of the movable portion 7. As described above, the guard rail 12 is fixed to the movable portion 7 by the holding portion 14, and the movable portion 7 is fixed to the fixed portion 5. Thus, the fixed portion 5, the movable portion 7, the holding portion 14, and the guard rail 12 integrally constitute the wheel guard apparatus 1.

As shown in FIG. 2, the wheel guard apparatus 1 is disposed on a longitudinal center line of the railroad tie 2, and a main line rail fixing bolt 26 by which the main line rail 3 is fixed to the railroad tie 2 is also formed on the same line. A positional relation between the main line rail 3 and the guard rail 12 is set such that in a state where the guard rail 12 and the main line rail 3 are laid with the predetermined interval S therebetween, the outer stopper portion 17 of the guard rail 12 is located above the main line rail fixing bolt 26 by which the main line rail 3 is fixed.

Hereinafter, respective components of the wheel guard apparatus 1 will be explained in detail. As shown in FIG. 3(*b*), the guard rail 12 having the substantially T-shaped cross section has the outer stopper portion 17 at the outer end of the horizontal portion thereof and the inner stopper portion 18 at the inner end of the horizontal portion thereof. The concave thread 21 extending in the longitudinal direction of the guard rail 12 is formed on the inner holding surface 20 of the vertical portion 19. In FIG. 3(*b*), the outer stopper portion 17 increases in thickness from the outer side toward the inner side. However, the thickness may be constant as shown in FIG. 1.

Moreover, as shown in FIG. 3(*a*), at an upstream portion of the guard rail 12 of the present embodiment in a vehicle proceeding direction, a cut portion 30 having a predetermined length is formed by obliquely cutting a part of the guard rail 12 from an upstream end portion of the guard rail 12 to a downstream outer stopper portion thereof. The cut portion 30 is formed at the outer stopper portion 17 at the upstream end portion of the guard rail 12. The guard rail 12 is obliquely cut from a position which is located at an upstream end of the guard rail 12 and on the inner side from the outer stopper portion by a predetermined length K, to an outer end of the downstream outer stopper portion by a predetermined length L. As shown in FIG. 3(*b*), even if the outer stopper portion 17 of the guard rail 12 receives a lateral force of the wheel W, and the guard rail 12 slightly bends toward the inner side, the wheel W can smoothly transfer from one guard rail 12 to the next guard rail 12 by forming the cut portion 30. The size of the cut portion 30 shown in FIGS. 3(*a*) and 3(*b*) is just one example and may be determined in accordance with an outer diameter of the wheel W, a curvature of the main line rail 3, and the like.

Further, in the present embodiment, the cut portion 30 is formed only at an outer side portion of the guard rail 12. However, the cut portion 30 may be formed at an inner side portion (portion shown by a chain double-dashed line X in FIG. 3(*a*)) of the upstream portion of the guard rail 12 in the vehicle proceeding direction. With this, in the case of the derailment shown in FIG. 13 described below, a deviation prevention protruding portion D can smoothly transfer from one guard rail 12 to the next guard rail 12.

As shown in FIG. 4(*a*), the fixed portion 5 is formed to have a rectangular shape in plan view. An inner fixed seat 31 and an outer fixed seat 32 are respectively provided at the inner side portion and the outer side portion of the fixed portion 5 to fix the fixed portion 5 to the railroad tie 2. The inner fixed seat 31 has an inner fixing elongated hole 33, and the outer fixed seat 32 has an outer fixing elongated hole 34. Each of the elongated holes 33 and 34 is formed to extend in the longitudinal direction of the fixed portion 5.

Moreover, an attaching portion 35 is formed at a substantially center portion of the fixed portion 5 to couple the fixed portion 5 to the movable portion 7. The attaching portion 35 has an upper elongated hole 36, a lower elongated hole 37, and a horizontal hole 38. The upper elongated hole 36 extends in the longitudinal direction of the fixed portion 5 so as to correspond to an elongated hole 55 formed on the movable portion 7 described below. The lower elongated hole 37 is formed under the upper elongated hole 36 and extends in a direction perpendicular to the upper elongated hole 36. The horizontal hole 38 is formed to have an arc shape such that a head portion 11 of the connecting bolt 9 inserted through the upper elongated hole 36 toward the lower elongated hole 37 can rotate toward the lower elongated hole 37. The connecting bolt 9 includes the head portion 11 having a T shape (FIG. 1). The head portion 11 is the same in shape as the upper elongated hole 36. In accordance with the attaching portion 35, the head portion 11 of the connecting bolt 9 is inserted through the upper elongated hole 36. Then, by fastening the connecting bolt 9 and the out 10, the head portion 11 automatically rotate from the horizontal hole 38 toward the lower elongated hole 37. Thus, the movable portion 7 can be coupled to the fixed portion 5 in a state where the head portion 11 is prevented from rotating by a wall of the lower elongated hole 37 (the state shown in FIG. 1).

A concave portion 46 that is one part of a load supporting portion 45 (FIG. 1) and is configured to support a load from the movable portion 7 is formed at a substantially center portion of an upper surface of the fixed portion 5. Moreover, a shaft supporting portion 39 of the rotating shaft 6 for rotatably supporting the movable portion 7 is formed on a track center side portion of the fixed portion 5 located on a right side in FIG. 1.

As shown in FIG. 4(*b*), the fixed portion 5 has a lower surface that is an inclined surface 41 corresponding to the inclination of the upper surface of the railroad tie 2. The upper surface (which contacts the movable portion 7) of the fixed portion 5 is formed to be horizontal in a state where the fixed portion 5 is fixed to the railroad tie 2. The shaft supporting portion 39 is formed to project upward from the upper surface of the fixed portion 5. On the surface shown in FIG. 4(*b*), a step portion 40 is formed to prevent a head portion (hexagon) of a bolt that is the rotating shaft 6 from rotating.

Moreover, as shown in FIG. 5, in the present embodiment, an upper surface of the inner fixed seat 31 is formed to have an inclination angle β that is larger than an inclination angle β of the upper surface of the railroad tie 2. With this, the inner fixed seat 31 is thick on the concave portion 46 side (load applied side) where the load is applied from the movable portion 7 to the fixed portion 5 and thin on the track center side (load non-applied side). Thus, the inner fixed seat 31 includes an inclined surface 47 formed such that the load applied side is thicker than the load non-applied side.

Further, in the present embodiment, an inclined washer 48 including a lower surface having the angle β and a horizontal upper surface is provided between the inner fixed seat 31 and the fixing bolt 8. The fixing bolt 8 is inserted from the upper surface of the inclined washer 48 to fix the inner fixed seat 31 to the railroad tie 2. With this, the inner fixed seat 31 is fixed to the railroad tie 2 by the fixing bolt 8 fixing vertically. The inner fixed seat 31 includes a tapered upper surface (inclined surface 47) which has a larger angle than the lower surface contacting the railroad tie 2 and is formed such that the side to which the load is applied from the guard rail 12 is thicker than the other side.

Figure 8:
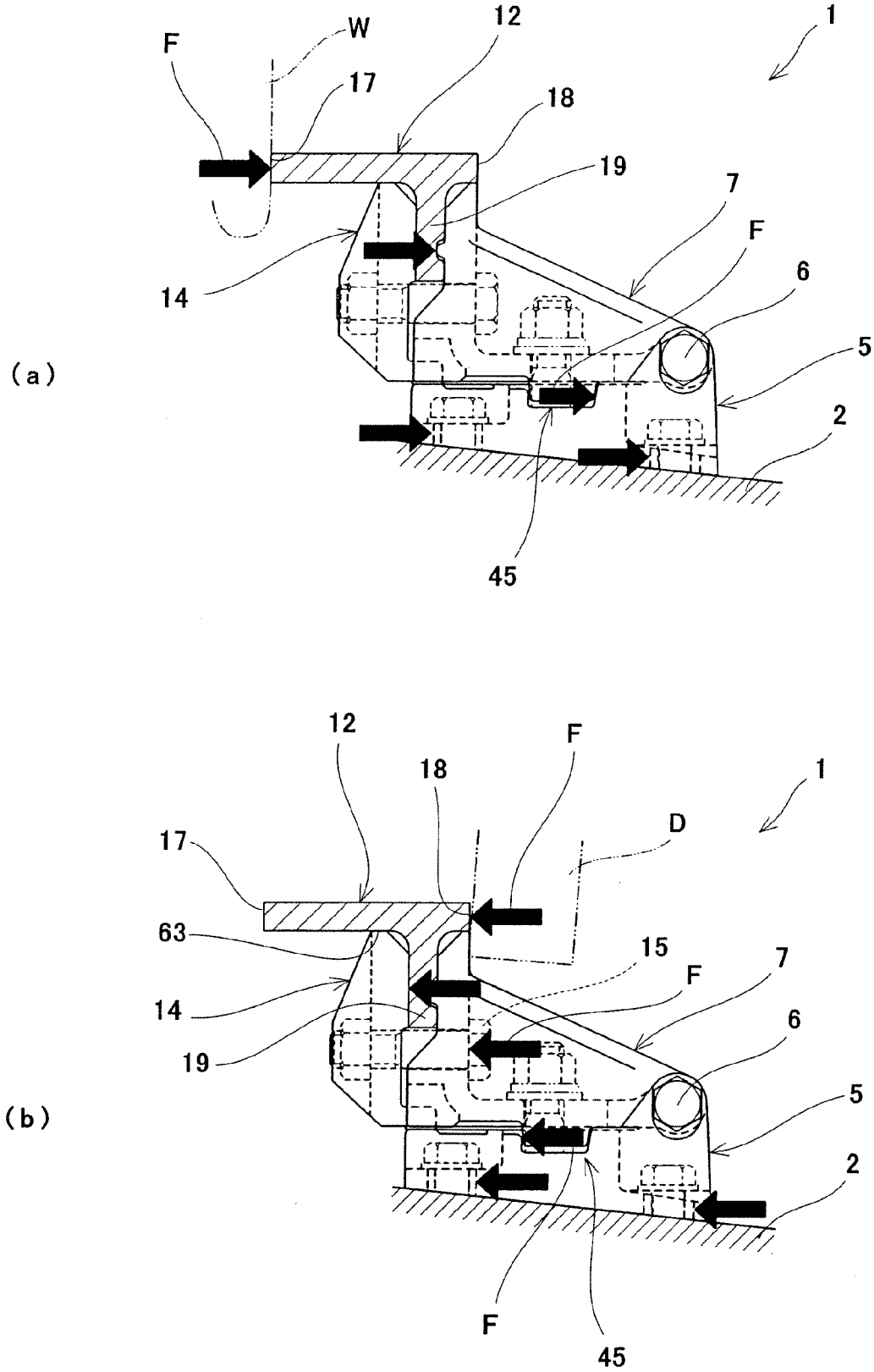
FIG. 8(*a*) is a front view showing a force relation in a case where a force is applied from an outer side to the guard rail of the wheel guard apparatus shown in FIG. 1.

Therefore, as shown in FIG. 8(*a*) described below, in a case where the load is applied from the outer stopper portion 17 of the guard rail 12, a wedging action can be obtained at the inner fixed seat 31 by the load. Therefore, even if the force of fixing the inner fixed seat 31 to the railroad tie 2 is reduced, the inner fixed seat 31 can be surely held by the wedging action. To be specific, the wedging action can be obtained by the load applied from the load supporting portion 45 toward the inner fixed seat 31. Therefore, even if a fastening force of the fixing bolt 8 is reduced, the inner fixed seat 31 can be caused to break into between the upper surface of the railroad tie 2 and the lower surface of the inclined washer 48 by the wedging action. Thus, the inner fixed seat 31 can be surely held.

In the present embodiment, the fixing bolt 8 is fastened from above the inclined washer 48 in the vertical direction. However, in a case where the fixing bolt 8 is fastened in a direction perpendicular to the upper surface of the inner fixed seat 31, the inclined washer 48 may be omitted.

The outer fixed seat 32 located on the outer side is formed to have a horizontal fixed surface 49 by cutting the fixed portion 5 from the upper surface thereof. With this, the outer fixed seat 32 between the fixed surface 49 and the inclined surface 41 (that is the upper surface of the railroad tie 2) is thick on the inner side and thin on the outer side. To be specific, the outer fixed seat 32 is thick on the concave portion 46 side (load applied side) where the load is applied from the movable portion 7 to the fixed portion 5 and thin at an end portion on the main line rail side (load non-applied side). Thus, the outer fixed seat 32 includes the inclined surface 41 formed such that the load applied side is thicker than the load non-applied side. Therefore, at the outer fixed seat 32, the wedging action can be obtained by the load applied from the inner side to the outer side. On this account, even if the force of fixing the outer fixed seat 32 to the railroad tie 2 is reduced, the outer fixed seat 32 can be surely held by the wedging action.

As shown in FIG. 6(*a*), the movable portion 7 includes a supporting hole 51 at one end thereof and a holding wall 52 at the other end thereof. The supporting hole 51 is supported by the rotating shaft 6 provided at the fixed portion 5 and extending in the horizontal direction. The holding wall 52 holds the vertical portion 19 of the guard rail 12. As described above, the convex thread 23 extending in the horizontal direction (direction perpendicular to the sheet of FIG. 6(*a*)) is formed at a vertically intermediate portion of the holding surface 22 of the holding wall 52. The holding wall 52 is supported by a side wall 53 extending toward the supporting hole 51. A bolt hole 54 is formed under the holding wall 52 to extend in the horizontal direction, and an upper end corner portion of the holding wall 52 on the holding surface side is chamfered so as not to contact a curved surface of the guard rail 12. The elongated hole 55 extending in the longitudinal direction is formed at a substantially center portion of the movable portion 7 so as to correspond to the upper elongated hole 36 of the attaching portion 35 formed at a substantially center portion of the fixed portion 5. Moreover, as shown in FIG. 6(*b*), a stopper wall 56 which is open toward the holding portion 14 side and has a predetermined width is formed under the holding wall 52.

Further, as shown in FIG. 6(*a*), a convex portion 57 that is another part of the load supporting portion 45 (FIG. 1)) and is configured to transfer the load to the concave portion 46 of the fixed portion 5 is formed at a substantially center portion of a lower portion of the movable portion 7. The convex portion 57 of the movable portion 7 and the concave portion 46 of the fixed portion 5 constitute the load supporting portion 45 configured to support the load. In the present embodiment, the load supporting portion 45 is constituted by a combination of the concave portion 46 and the convex portion 57. However, the load supporting portion 45 is not limited to the present embodiment and may be constituted by a concave and convex structure including a curved surface or an oblique surface.

A shown in FIG. 7, the holding portion 14 has a bolt hole 61 at a width-direction center portion thereof so as to be communicated with the bolt hole 54 of the movable portion 7, and reinforced walls 62 are respectively formed on both sides of the bolt hole 61. Moreover, an upper end supporting surface 63 is formed at an upper end of the holding portion 14 so as to have a circular-arc shape around the bolt hole 61 that is the attaching portion. As shown in FIG. 1, the upper end supporting surface 63 is formed to substantially contact the lower surface of the outer stopper portion 17 of the guard rail 12 when the guard rail 12 is sandwiched between the holding portion 14 and the movable portion 7. Moreover, a whirl-stop portion 64 projecting toward the movable portion 7 is formed at a lower end of the holding portion 14 (see a side view in FIG. 1). When fixing the holding portion 14 to the movable portion 7, the whirl-stop portion 64 is inserted between the stopper walls 56 to prevent the holding portion 14 from rotating.

As shown in FIG. 1, the holding portion 14 is fixed to the movable portion 7 by the rail fixing bolt 15 and the nut 16 in a state where the whirl-stop portion 64 is inserted between the stopper walls 56 of the movable portion 7. At this time, the holding portion 14 may rotate clockwise (in the case of a right-hand screw) by fastening the nut 16. However, the holding portion 14 is prevented from rotating in a state where the whirl-stop portion 64 contacts the stopper wall 56. Since the holding portion 14 rotates due to a gap (backlash) between components formed in consideration of manufacturing errors of respective components, the holding portion 14 in this state is fixed so as to be slightly inclined. However, since the upper end supporting surface 63 is formed to have the circular-arc shape around the guard rail fixing bolt 15, a distance from the guard rail fixing bolt 15 is always constant. Therefore, the holding portion 14 can be fixed so as to substantially contact the lower surface of the outer stopper portion 17 of the guard rail 12. Thus, even if the holding portion 14 inclines, it does not apply an upwardly pressing force to the outer stopper portion 17 of the guard rail 12 from under the outer stopper portion 17.

FIG. 8(*a*) is a front view showing a force relation in a case where a force is applied from the outer side to the guard rail of the wheel guard apparatus shown in FIG. 1. FIG. 8(*b*) is a front view showing a force relation in a case where a force is applied from the inner side to the guard rail of the wheel guard apparatus. The wheel guard apparatus 1 assembled using the above components as shown in FIGS. 1 and 2 can support the load applied to the guard rail 12 in the following manner.

To be specific, as shown in FIG. 8(*a*), in a case where the wheel W is about to derail from the main line rail 3 to contact the outer stopper portion 17 of the guard rail 12, a load F of the vehicle can be supported by the movable portion 7 via the vertical portion 19 of the guard rail 12, the load F supported by the movable portion 7 can be supported by the fixed portion 5 via the load supporting portion 45, and the load F can be supported by the railroad tie 2 via the fixed portion 5.

In contrast, as shown in FIG. 8(*b*), in a case where the wheel W has derailed from the guard rail 12, and the vehicle (FIG. 9) is about to deviate to the outer side of the track and the deviation prevention protruding portion D (component provided at a lower portion of the vehicle; see FIG. 13) provided at the lower portion of the vehicle contacts the inner stopper portion 18 of the guard rail 12, the load F can be supported by the holding portion 14 via the vertical portion 19 of the guard rail 12, the load F supported by the holding portion 14 can be supported by the movable portion 7 via the rail fixing bolt 15 by which the holding portion 14 is fixed, the load F supported by the movable portion 7 can be supported by the fixed portion 5 via the load supporting portion 45, and the load F can be supported by the railroad tie 2 via the fixed portion 5. Moreover, in the case of supporting the load F applied from the inner side to the guard rail 12, the load applied downward from the outer stopper portion 17 of the guard rail 12 is supported by the upper end supporting surface 63 of the holding portion 14.

Further, both the load F applied from the outer side to the guard rail 12 and the load F applied from the inner side to the guard rail 12 are supported via the load supporting portion 45 constituted by the concave portion 46 and the convex portion 57 provided between the movable portion 7 and the fixed portion 5. Therefore, the load can be surely supported by a large contact area of the load supporting portion 45. In addition, since the load is supported by the load supporting portion 45 and is not applied to the rotating shaft 6, the reliability of the rotating shaft 6 can be improved.

Moreover, as shown in FIG. 5 described above, the inner fixed seat 31 includes the inclined surface 47 formed such that the load applied side is thicker than the load non-applied side. Therefore, as shown in FIG. 8(*a*) described above, in a case where the load is applied from the outer stopper portion 17 of the guard rail 12, and even if the fixing bolt 8 is loose, the inner fixed seat 31 breaks into between the upper surface of the railroad tie 2 and the lower surface of the inclined washer 48 by the wedging action, so that the fixed portion 5 can be surely held. Further, although not shown in detail, as described above, the outer fixed seat 32 has the inclined surface 41 formed such that the load applied side is thicker than the load non-applied side. Therefore, as shown in FIG. 8(*b*) described above, in a case where the load is applied from the inner stopper portion 18 of the guard rail 12, and even if the fixing bolt 8 is loose, the outer fixed seat 32 breaks into between the upper surface of the railroad tie 2 and the fixing bolt 8 by the wedging action, so that the fixed portion 5 can be surely held.

Figure 9:
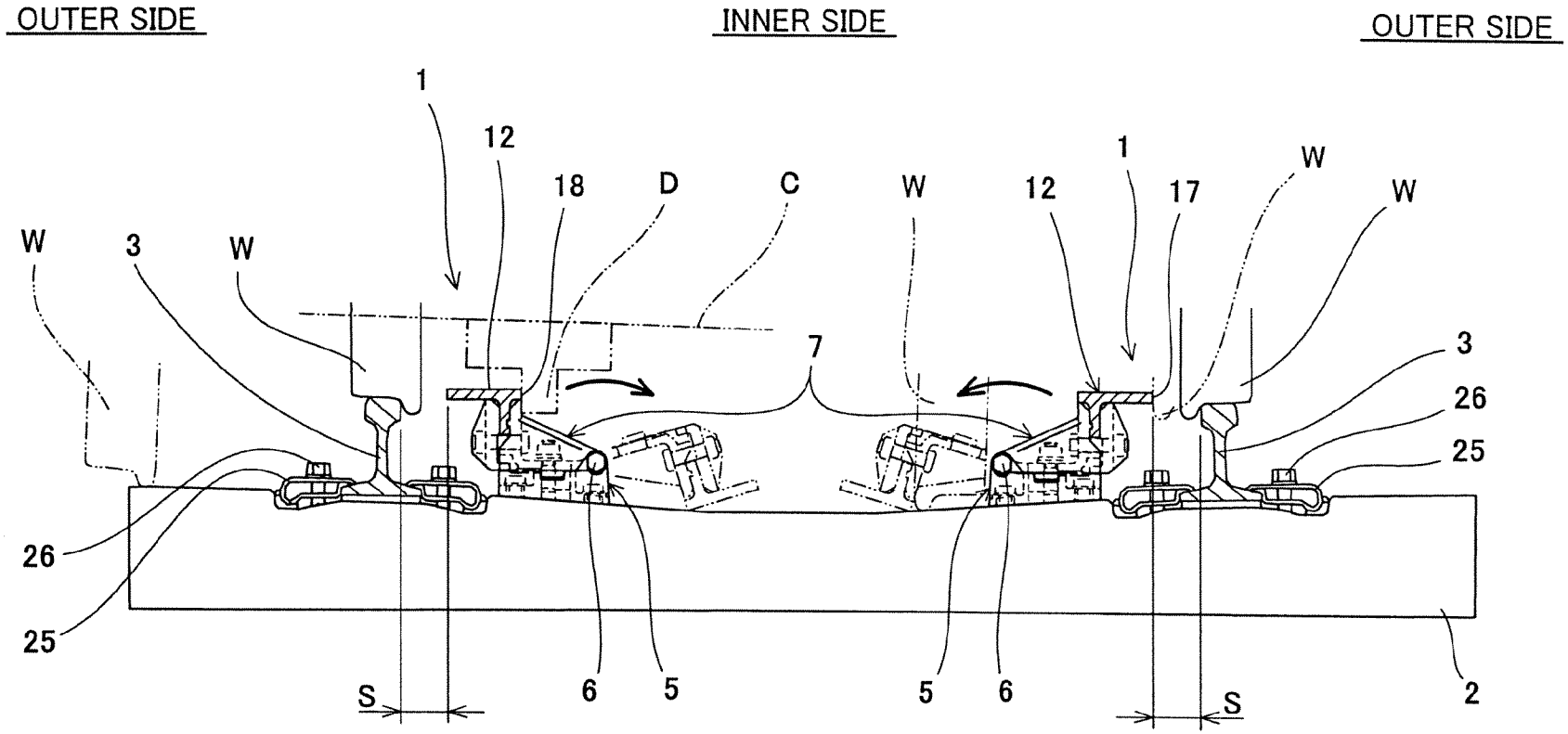
FIG. 9 is a front view of the main line rail including the wheel guard apparatus shown in FIG. 1.
Figure 10:
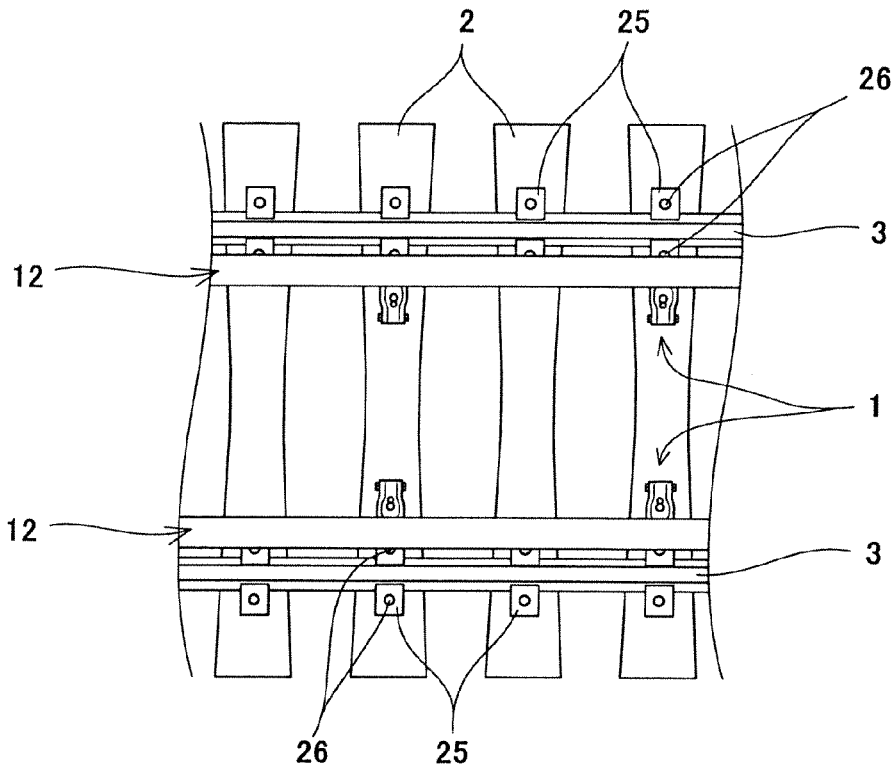
FIG. 10 is a plan view of the main line rail including the wheel guard apparatus shown in FIG. 1.

FIG. 9 is a front view of the main line rail including the wheel guard apparatus shown in FIG. 1. FIG. 10 is a plan view of the main line rail including the wheel guard apparatus. As shown in FIG. 9, the wheel guard apparatus 1 is provided on the track center side of the main line rail 3 such that the predetermined interval S is provided between the outer stopper portion 17 of the guard rail 12 and the inner end portion of the main line rail 3. Moreover, as shown in FIG. 10, the wheel guard apparatus 1 is fixed for every few railroad ties 2. The guard rail 12 having a predetermined length is supported by a plurality of wheel guard apparatuses 1. With this, as shown in FIG. 9, even if each of both wheels W on the main line rails 3 is about to derail toward the track center side, the wheel W contacts the outer stopper portion 17 of the guard rail 12 to be prevented from derailing. Moreover, even if the wheel W has derailed, the deviation prevention protruding portion D of a vehicle C contacts the inner stopper portion 18 of the guard rail 12, so that the vehicle C is prevented from seriously deviating from the track.

Figure 16:
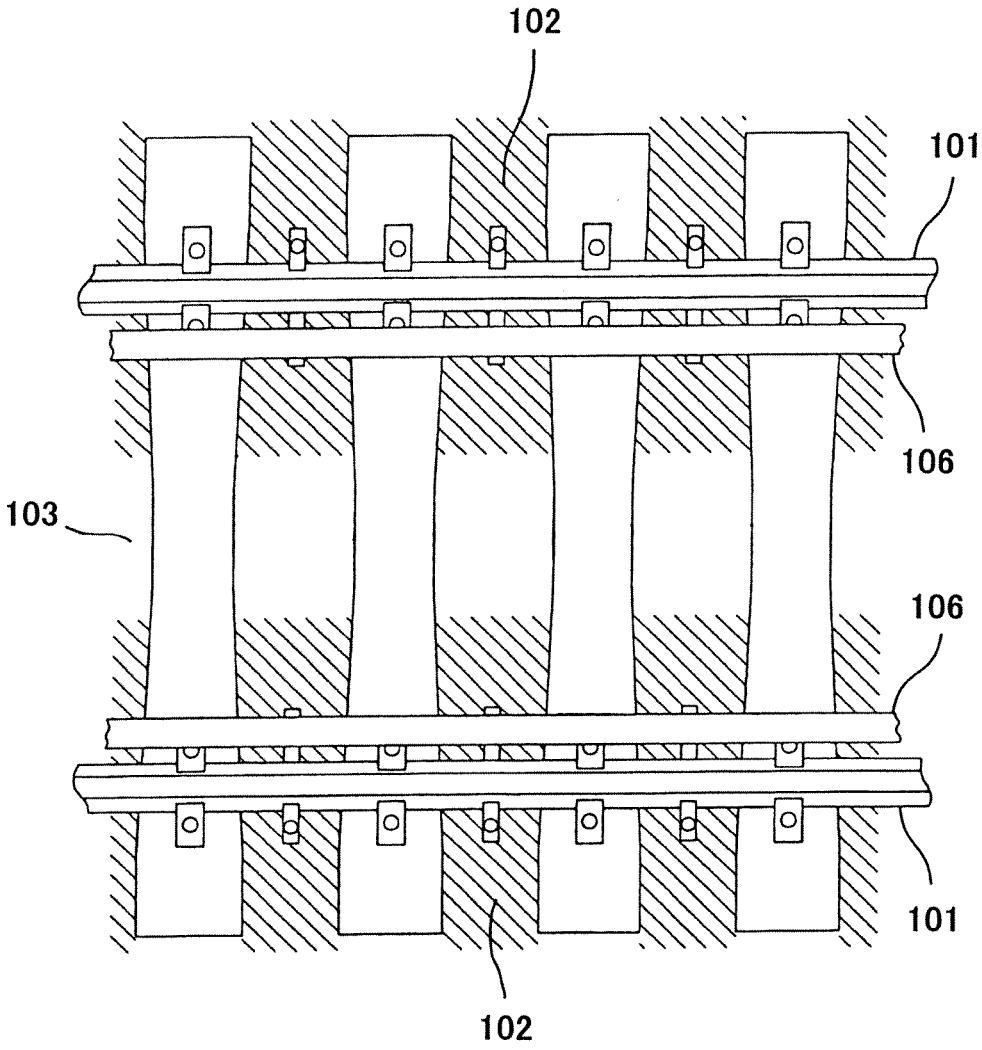
FIG. 16 is a plan view showing a working range of a tie tamper configured to tamp the ballast shown in FIG. 14 and positions of the main line rail and a derailment preventing guard rail.

As shown in FIG. 10, the guard rail 12 is laid so as to be located above the main line rail fixing bolt 26 fixing the main line rail 3. However, as shown by the chain double-dashed line in FIG. 9, by causing the movable portion 7 to rotate around the rotating shaft 6 of the wheel guard apparatus 1 toward the track center side, the guard rail 12 can be evacuated to an evacuation position on the track center side (inner side). As above, by causing the guard rail 12 to rotate and be evacuated toward the track center side, the guard rail 12 can be evacuated from the working range (see FIG. 16) when tamping the ballast in the vicinity of the main line rail 3 by the tamping machine as above, when grinding the main line rail 3, when replacing the main line rail 3, and the like. Therefore, it is possible to prevent the guard rail 12 from becoming an obstacle for the work by the tamping machine, the work by the rail grinding vehicle, and the like. The guard rail 12 (chain double-dashed line) evacuated on the track center side as above is the guard rail 12 located at the evacuation position.

Further, the work of evacuating the guard rail 12 to the track center side can be carried out by unfastening the nut 10 of the connecting bolt 9 by which the movable portion 7 is coupled to the fixed portion 5 and causing the movable portion 7 to rotate to the track center side. Therefore, the work of causing the guard rail 12 that is the heavy product to move to an outside of the working range of the tamping machine or an outside of the working range of the rail grinding vehicle becomes easy. Thus, it is possible to significantly reduce the labor.

Figure 11:
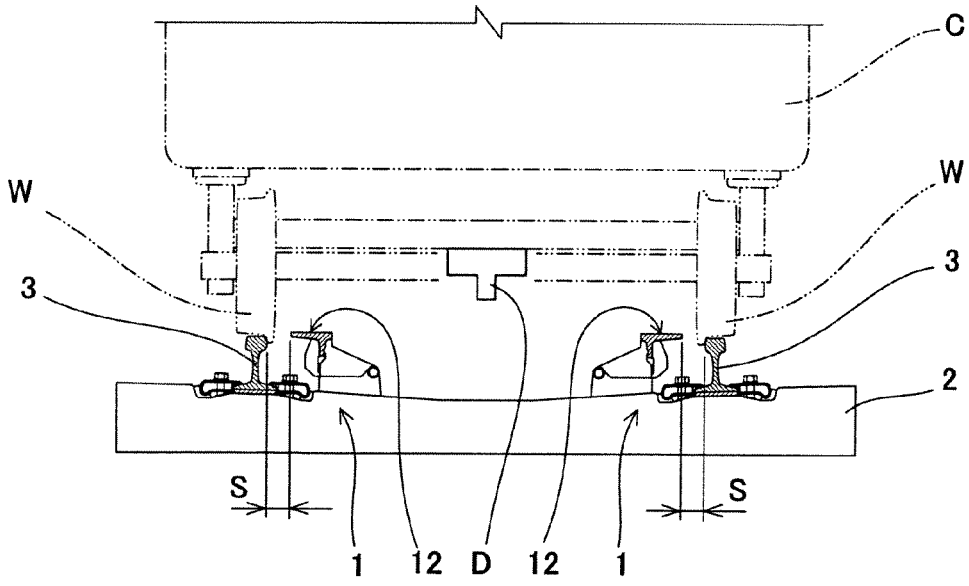
FIG. 11 is a front view showing the main line rail including the wheel guard apparatus shown in FIG. 1 and a running vehicle.
Figure 12:
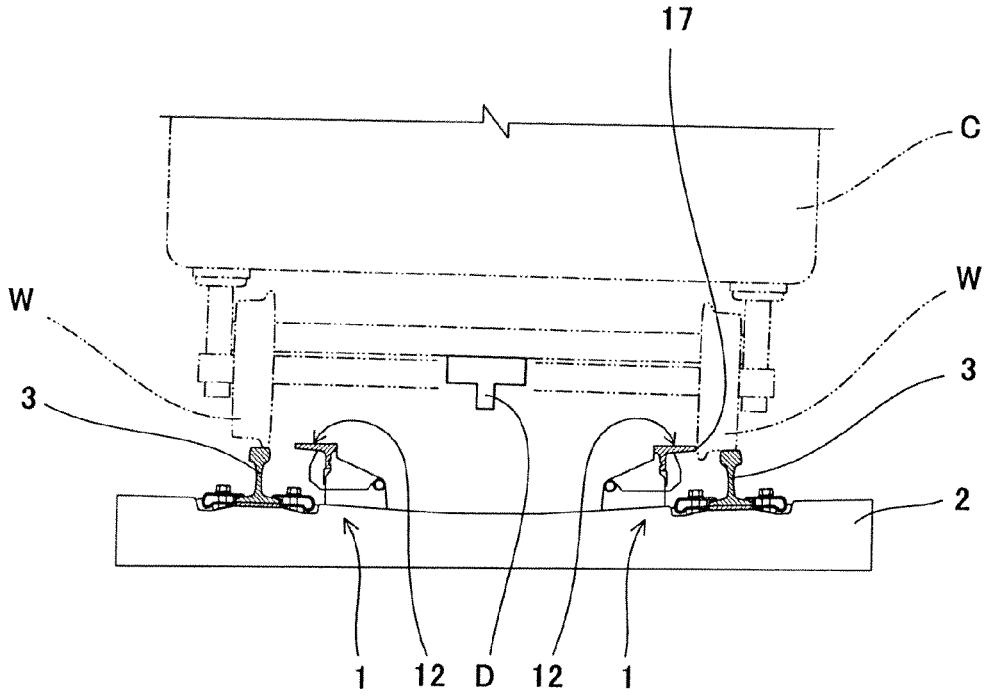
FIG. 12 is a front view showing that the wheel guard apparatus prevents the running vehicle shown in FIG. 11 from derailing from the main line rail.
Figure 13:
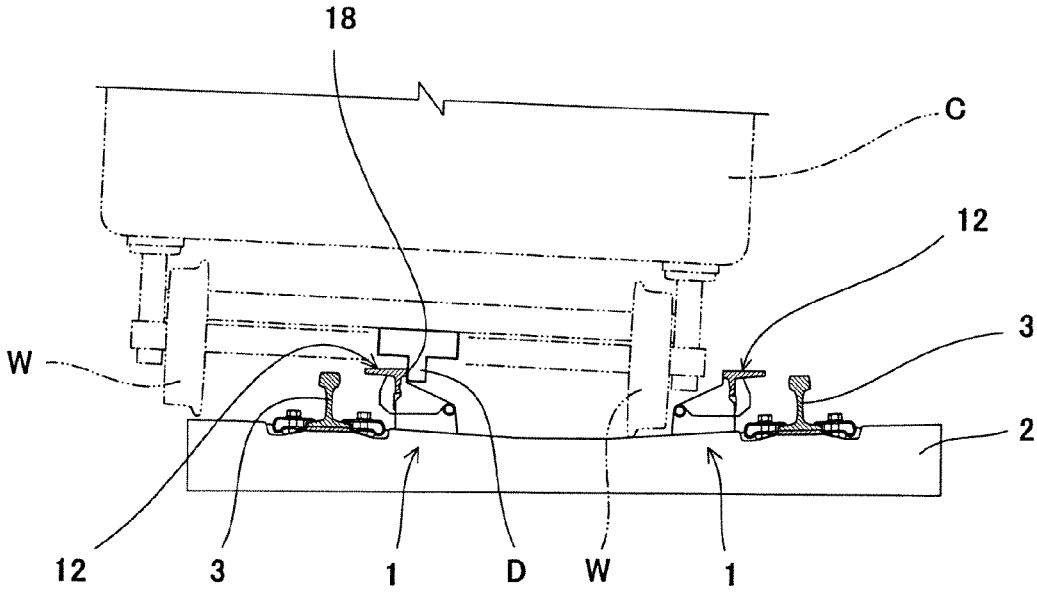
FIG. 13 is a front view showing that although the running vehicle shown in FIG. 12 has derailed from the main line rail, the wheel guard apparatus prevents the running vehicle from deviating to an outer side of the track.

FIG. 11 is a front view showing the main line rail including the wheel guard apparatus shown in FIG. 1 and a running vehicle. FIG. 12 is a front view showing that the wheel guard apparatus prevents the running vehicle shown in FIG. 11 from derailing from the main line rail. FIG. 13 is a front view showing that although the running vehicle shown in FIG. 12 has derailed from the main line rail, the wheel guard apparatus prevents the running vehicle from deviating to the outer side of the track.

As shown in FIG. 11, the wheel W of the vehicle C running on the main line rail 3 including the wheel guard apparatus 1 runs on the main line rail 3 and can run while maintaining a predetermined gap between the wheel W and the guard rail 12. As shown in FIG. 11, the deviation prevention protruding portions D are provided on the lower surface of the vehicle C at predetermined intervals (for example, at front and rear positions of the vehicle C) in the longitudinal direction. The deviation prevention protruding portion D prevents the vehicle C from seriously deviating from the track by the guard rail 12 when the wheel W has derailed.

As shown in FIG. 12, in a case where a high lateral force (herein, a lateral force applied from a right side in FIG. 12) is applied to the vehicle C, one (left-side wheel in FIG. 12) of the wheels runs on the main line rail 3, and the inner side portion of the other one (right-side wheel in FIG. 12) of the wheels W contacts the guard rail 12 and is guarded. In this case, since the right-side wheel W in FIG. 12 is running on the main line rail 3, the wheel W is prevented from derailing.

Then, as shown in FIG. 13, in a case where the lateral force has further increased and the wheel W has run over the guard rail 12 and derailed, the vehicle C may run toward the outer side of the track by the lateral force. However, the deviation prevention protruding portion D provided at the lower portion of the vehicle C can contact the inner stopper portion 18 of the guard rail 12 to prevent the vehicle C from seriously deviating. With this, even if the vehicle C has derailed, the vehicle C can stop without contacting the oncoming vehicle.

Figure 14:
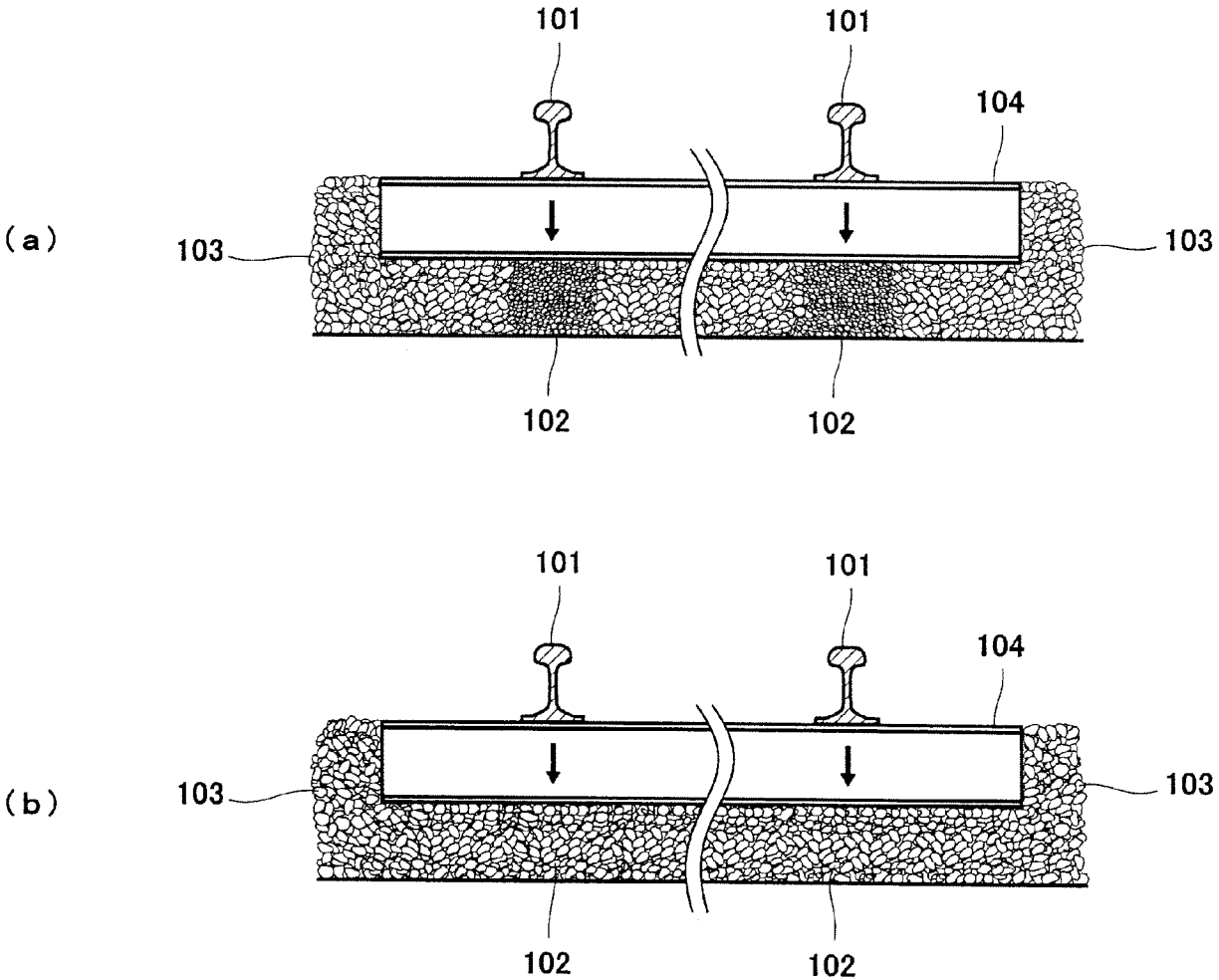
FIGS. 14(*a*) and 14(*b*) are diagrams showing one example of the density of the ballast immediately under the main line rail and in the vicinity of the main line rail.
Figure 15:
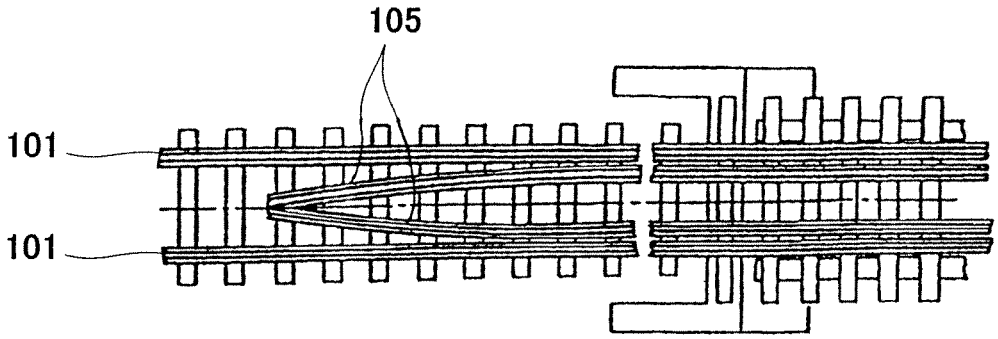
FIGS. 15(*a*) and 15(*b*) are plan views showing one example of a safety rail laid along the main line rail.
Figure 15:
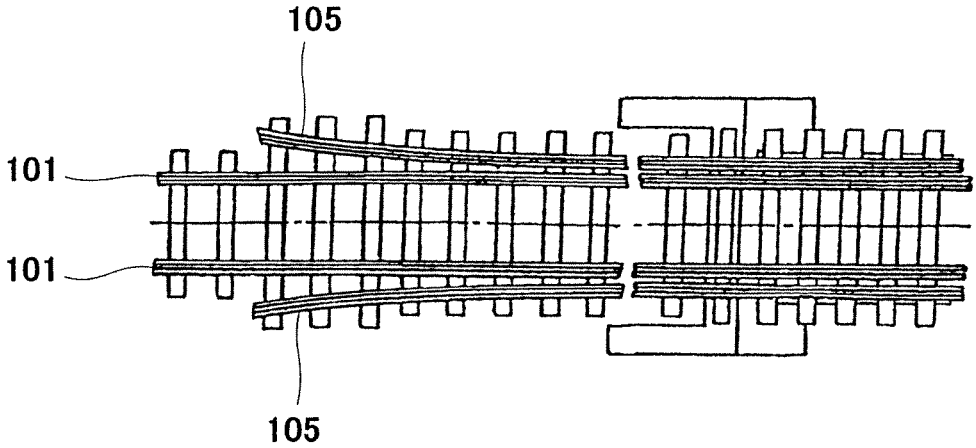

As above, in accordance with the wheel guard apparatus 1, when stamping the ballast 102 (FIG. 14) in the vicinity of the main line rail 3, when grinding the main line rail 3, when replacing the main line rail 3, and the like, the guard rail 12 can be evacuated from the vicinity of the main line rail 3 to the track center side, so that the work space can be easily secured around the main line rail 3.

Then, in a state where the wheel guard apparatus 1 is provided along the main line rail 3, the wheel W can be stably prevented from derailing by the outer stopper portion 17. In addition, even if the wheel W has derailed from the main line rail 3, the inner stopper portion 18 can support the deviation prevention protruding portion D of the vehicle C to prevent the vehicle C from significantly deviating from the track. Further, the high load applied to the guard rail 12 when preventing the wheel W from derailing and when preventing the vehicle C from deviating can be stably received by the large area of the load supporting portion 45 provided between the movable portion 7 and the fixed portion 5. Therefore, the high load can be stably supported.

In addition, in the present embodiment, the wheel guard apparatus 1 is fixed to the railroad tie 2 (slab track) by the fixed seats 31 and 32 which obtains, by the load applied to the guard rail 12, the wedging action by which the wheel guard apparatus 1 is held by the railroad tie 2 (slab track). Therefore, a secure guard function can be maintained in the vicinity of the main line rail 3 which vibrates all the time.

The above embodiment has been explained using the railroad tie 2 as an example. However, even in the case of the slab track, the same configuration as above can be realized. The configuration on the track side where the wheel guard apparatus 1 is provided is not limited to the above embodiment.

Moreover, the above embodiment is just one example. Various modifications can be made within the scope of the present invention. The present invention is not limited to the above embodiment.

INDUSTRIAL APPLICABILITY

The guard apparatus according to the present invention is applicable to the track such that: the guard apparatus can be evacuated when stamping the ballast along the main line rail; when the guard apparatus of the present invention is set, it can prevent the wheel from derailing; and even if the wheel has derailed, the guard apparatus can prevent the vehicle from deviating from the track.

The invention claimed is:

1. A wheel guard apparatus comprising:

a fixed portion fixed to a base member located between main line rails;

a movable portion supported by a rotating shaft provided on the fixed portion and extending in a horizontal direction and configured to be rotatable around the rotating shaft toward a track center side;

a guard rail located at a position separated from the rotating shaft of the movable portion and held to extend in parallel with the main line rail; and a holding portion having a bolt hole and fastened to the movable portion by a bolt and a nut with the guard rail sandwiched between the holding portion and the movable portion; wherein the guard rail includes an outer stopper portion configured to prevent the wheel from derailing toward an inner side of the main line rail and an inner stopper portion configured to prevent a derailed vehicle from deviating to an outer side of a track and the holding portion includes an upper end supporting surface contacting the guard rail and having a circular-arc shape, the circular-arc shape being concentric with an axis of the bolt.

2. The wheel guard apparatus according to claim 1, wherein a holding surface of the movable portion is arranged to hold the guard rail and includes a convex thread configured to prevent the guard rail from shifting in a vertical direction.

3. The wheel guard apparatus according to claim 1, wherein a load supporting portion configured to support a load applied from the movable portion to the fixed portion is provided on a top surface of the fixed portion.

4. The wheel guard apparatus according to claim 1, wherein:

the fixed portion includes a fixed seat having a hole by which the fixed portion is fixed to base member using a fixing member; and the fixed seat includes an inclined surface formed such that a load applied side of the fixed seat to which side the load is applied from the movable portion to the fixed portion is thicker than a load non-applied side of the fixed seat.

5. The wheel guard apparatus according to claim 1, wherein a partially cut portion having a predetermined length extending from an upstream end portion of the guard rail to a downstream outer stopper portion is formed at an outer side portion of an upstream portion of the guard rail in a vehicle proceeding direction.

6. The wheel guard apparatus according to claim 1, wherein the movable portion includes a pair of stopper walls, and the holding portion includes a whirl-stop portion projecting between the stopper walls so that the holding portion engages with the movable portion.

* * * * *

UNITED STATES PATENT AND TRADEMARK OFFICE

CERTIFICATE OF CORRECTION

PATENT NO. : 8,418,932 B2
APPLICATION NO. : 12/745243
DATED : April 16, 2013
INVENTOR(S) : Seki et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 298 days.

Signed and Sealed this
First Day of September, 2015

Michelle K. Lee

Michelle K. Lee
*Director of the United States Patent and Trademark Office*